US006269146B1

(12) United States Patent
Ohnishi et al.

(10) Patent No.: US 6,269,146 B1
(45) Date of Patent: Jul. 31, 2001

(54) ROTATING ANODE X-RAY TUBE CAPABLE OF EFFICIENTLY DISCHARGING INTENSE HEAT

(75) Inventors: Masayoshi Ohnishi, Tondabayashi; Daiji Hiraoka, Ikoma-gun; Kazunori Hayashida, Osakasayama, all of (JP)

(73) Assignee: Koyo Seiko Co., Ltd., Osaka (JP)

( * ) Notice: Subject to any disclaimer, the term of this patent is extended or adjusted under 35 U.S.C. 154(b) by 0 days.

(21) Appl. No.: 09/335,777

(22) Filed: Jun. 18, 1999

(30) Foreign Application Priority Data

Jun. 19, 1998 (JP) ..... 10-173052

(51) Int. Cl.[7] ..... H01J 35/10

(52) U.S. Cl. ..... 378/130; 378/132; 378/133; 277/300

(58) Field of Search ..... 378/130, 132, 378/133; 277/300, 301, 303, 304

(56) References Cited

U.S. PATENT DOCUMENTS

| | | | | |
|---|---|---|---|---|
| 3,694,685 | | 9/1972 | Houston | 378/130 |
| 4,290,611 | | 9/1981 | Sedy | 277/366 |
| 5,201,531 | * | 4/1993 | Lai | 277/96.1 |
| 5,210,781 | * | 5/1993 | Ono et al. | 378/125 |
| 5,381,456 | * | 1/1995 | Vetter et al. | 378/132 |
| 5,541,975 | * | 7/1996 | Anderson et al. | 378/130 |
| 5,668,849 | * | 9/1997 | Sugiura et al. | 378/133 |
| 5,737,387 | | 4/1998 | Smither | 378/130 |
| 5,799,951 | * | 9/1998 | Anderson et al. | 277/301 |
| 5,875,227 | | 2/1999 | Bhatt | 378/132 |
| 6,192,107 | * | 2/2001 | Price et al. | 378/130 |

FOREIGN PATENT DOCUMENTS

| | | |
|---|---|---|
| 36 44 719 | 3/1988 | (DE) . |
| 5-258691 | 10/1993 | (JP) . |
| 95/19039 | 7/1995 | (WO) . |

* cited by examiner

*Primary Examiner*—Robert H. Kim
*Assistant Examiner*—Allen C. Ho
(74) *Attorney, Agent, or Firm*—Wenderoth, Lind & Ponack, L.L.P.

(57) ABSTRACT

There is provided a rotating anode X-ray tube capable of efficiently discharging intense heat generated when X-rays are generated and achieving a high output power, a long-time continuous operation and a long operating life of the bearings. A rotating anode X-ray tube is provided with a target, a rotor, a shaft, rolling bearings and a bearing housing for supporting the rolling bearings. An accommodating, section for accommodating Ga or Ga alloy is defined by a center portion of the shaft and an inner surface of the bearing housing between the rolling bearings. Pumping grooves and labyrinth grooves are provided axially outwardly of the accommodating section for preventing the Ga or Ga alloy from leaking.

10 Claims, 3 Drawing Sheets

ROTATING ANODE X-RAY TUBE CAPABLE OF EFFICIENTLY DISCHARGING INTENSE HEAT

BACKGROUND OF THE INVENTION

The present invention relates to a rotating anode X-ray tube capable of discharging intense heat generated when X-rays are generated.

Conventionally, there has been a rotating anode X-ray tube as shown in FIG. 4. In this rotating anode X-ray tube 50, X-rays 53 are generated from a target 52 when an electron beam 51 is applied from a cathode (not shown) to the target 52 in a vacuum. At the same time, most of the kinetic energy of the electron beam 51 is transformed into heat, causing an intense heat in the target 52. The heat of this target 52 is directly discharged outwardly of a vacuum tube 55 by radiation from the target 52 and a rotor 54 and is also discharged to the outside by heat conduction via a shaft 56, bearings 57 and a bearing housing 58.

However, in the above prior art rotating anode X-ray tube 50, the heat of the shaft 56 is conducted from the shaft 56 to the bearing housing 58 through only very small surfaces of contact between a race and balls 59 of the bearings 57, and this has led to the problem that the heat of the shaft 56 does not efficiently escape.

As described above, the inefficient escape of the heat of the shaft 56 has led to the problem that the cooling of the target 52 connected to the shaft 56 becomes insufficient to enable the increase in output power of the X-rays 53 and the continuous operation of the X-ray tube.

Furthermore, the inefficient escape of the heat of the shaft 56 has also led to the problem that the shaft 56 and the bearings 57 put in contact with the shaft 56 come to have an elevated temperature to impair the capability of the solid lubricant in the bearings 57 and extremely reduce the operating life of the bearings 57.

SUMMARY OF THE INVENTION

Accordingly, the object of the present invention is to provide a rotating anode X-ray tube capable of efficiently discharging intense heat generated when X-rays are generated and achieving a high output power, a long-time continuous operation and a long operating life of the bearings.

In order to achieve the above object, the present invention provides a rotating anode X-ray tube comprising:

- a supported member connected to a target;
- a supporting member for supporting the supported member via rolling bearings;
- an accommodating section formed between the supported member and the supporting member; and
- a liquid metal that is accommodated in the accommodating section and does not substantially evaporate even in a vacuum.

According to the rotating anode X-ray tube of the present invention, the liquid metal is accommodated in the accommodating section formed between the supported member and the supporting member. Therefore, heat conducted from the target to the supported member is efficiently conducted via the liquid metal to the supporting member and discharged to the outside. Further, the liquid metal also operates as a coolant. Therefore, the target, the supported member and the bearing are prevented from having an increased temperature, so that a high output power, a long-time continuous operation and a long operating life of the bearing can be achieved.

In one embodiment, the liquid metal is comprised of Ga or Ga alloy and the accommodating section put in contact with the Ga or Ga alloy is made of an anti-corrosion metal having a corrosion resistance to the-Ga or Ga alloy or of an anti-corrosion ceramic.

In the above embodiment, the liquid metal is comprised of Ga (gallium) or Ga alloy, and the accommodating section is formed of an anti-corrosion metal having a corrosion resistance to the Ga or Ga alloy or of an anti-corrosion ceramic. Therefore, the accommodating section is not corroded by the Ga or Ga alloy.

In one embodiment, the liquid metal is comprised of Ga or Ga alloy and the accommodating section put in contact with the Ga or Ga alloy is formed of stainless steel or tool steel coated with TiN.

In the above embodiment, the accommodating section is formed of stainless steel or tool steel coated with TiN. Therefore, the accommodating section is not corroded by the Ga or Ga alloy. The accommodating section, which is formed of stainless steel or tool steel coated with TiN, can be manufactured at lower cost than when entirely made of the anti-corrosion material having a corrosion resistance to Ga or Ga alloy.

One embodiment further comprises an infusion hole for infusing the liquid metal into the accommodating section.

The above embodiment, which is provided with the infusion hole for infusing the liquid metal into the accommodating section, facilitates the infusion of the liquid metal into the accommodating section, allowing the liquid metal to be easily replenished even when the liquid metal is wasted during use.

In one embodiment, the infusion hole is threaded and plugged with a screw plug.

In the above embodiment, the infusion hole is threaded and plugged with the screw plug. Therefore, the liquid metal does not leak out of the infusion hole.

In one embodiment, the accommodating section is provided substantially in an axial center portion between a plurality of the rolling bearings and the accommodating section has tapered surfaces of which the diameter is maximized at the axial center and reduces toward axial ends.

In the above embodiment, the accommodating section has the tapered surfaces of which the diameter is maximized at the axial center and reduces toward axial ends. Therefore, the accommodating section is easily closely filled with the liquid metal. While the shaft is rotating, the liquid metal is gathered into the axial center portion where the diameter of the accommodating section is maximized due to a centrifugal force exerted on the liquid metal, so that the liquid metal can be prevented from leaking out of the accommodating section.

In one embodiment, a gap between the supported member and the supporting member is not greater than 0.2 mm axially outside the accommodating section.

In the above embodiment, the gap between the supported member and the supporting member is not greater than 0.2 mm axially outside the accommodating section. Therefore, the liquid metal is prevented from leaking out of the accommodating section. This was confirmed through experiment.

In one embodiment, a pumping groove for forcing the liquid metal located in the gap between the supported member and the supporting member back into the accommodating section is provided on the supported member or the supporting member.

In the above embodiment, the pumping groove formed on the supported member or the supporting member forces the liquid metal, which is located in the gap between the supported member and the supporting member, back into the accommodating section. Therefore, the liquid metal is prevented from leaking out of the accommodating section.

In one embodiment, a labyrinth groove for reserving the liquid metal is formed adjacently outside the pumping groove.

In the above embodiment, if the liquid metal should leak out of the accommodating section and further to the outside of the pumping groove, then the labyrinth groove formed adjacently outside the pumping groove catches the liquid metal.

In one embodiment, the pumping groove has a groove angle of 10 to 20 degrees with respect to a flat plane perpendicular to the axial direction of the supported member.

In the above embodiment, the pumping groove has the groove angle of 10 to 20 degrees with respect to the flat plane perpendicular to the axial direction of the supported member. With this arrangement, the pumping groove ensures the pumping force for forcing the liquid metal back into the accommodating section while the supported member is rotating, and the leakage of the liquid metal from the pumping groove when the supported member is in a state of rest is suppressed. If the groove angle of the pumping groove exceeds 20 degrees, then the pumping force increases in operation to force the liquid metal back into the accommodating section, while the groove length becomes short to let the liquid metal leak to the outside through this pumping groove in the state of rest. Conversely, if the groove angle is smaller than 10 degrees, then the groove length becomes long to scarcely leak the liquid metal to the outside in the state of rest, while the pumping force reduces in operation to weaken the force for forcing the liquid metal back into the accommodating section. This was confirmed through experiment.

One embodiment comprises:

a cylindrical supporting member and a columnar supported member, which rotate relative to each other;

a liquid metal interposed between the supporting member and the supported member; and a pumping groove formed on the supporting member or the supported member, wherein the pumping groove has a groove angle of 10 to 20 degrees with respect to a flat plane perpendicular to an axial direction of the supported member.

In the above embodiment, the pumping groove has the groove angle of 10 to 20 degrees with respect to the flat plane perpendicular to the axial direction of the columnar supported member. With this arrangement, the pumping groove ensures the pumping force for forcing the liquid metal back into the accommodating section while the columnar supported member is rotating, and the leakage of the liquid metal from the pumping groove when the columnar supported member is in the state of rest is suppressed. If the groove angle of the pumping groove exceeds 20 degrees, then the pumping force increases in operation to force the liquid metal back into the accommodating section, while the groove length becomes short to let the liquid metal leak to the outside through this pumping groove in the state of rest. Conversely, if the groove angle is smaller than 10 degrees, then the groove length becomes long to scarcely leak the liquid metal to the outside in the state of rest, while the pumping force reduces in operation to weaken the force for forcing the liquid metal back into the accommodating section. This was confirmed through experiment.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
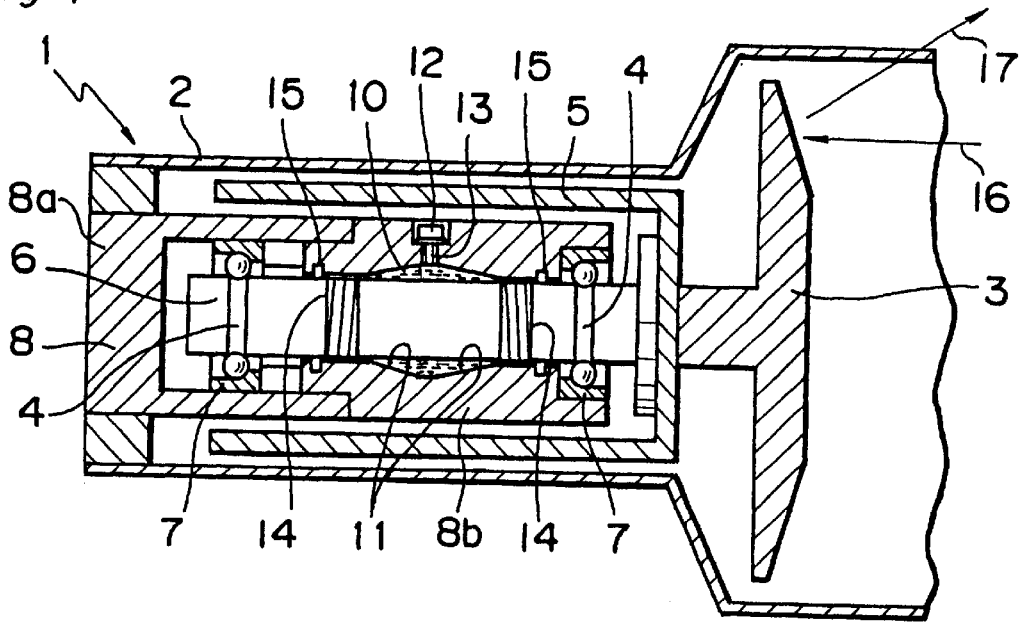
FIG. 1 is a sectional view of a rotating anode X-ray tube according to one embodiment of the present invention.

The present invention will be described in detail below on the basis of the embodiments thereof shown in the drawings.

FIG. 1 is a sectional view of a rotating anode X-ray tube according to one embodiment of the present invention. This rotating anode X-ray tube 1 includes, a disk-shaped target 3, a shaft 6 that serves as a supported member connected to the center of this target 3 and a cylindrical rotor 5 fixed to the shaft 6 coaxially with the shaft 6, in a cylindrical vacuum tube 2 with a step. The rotating anode X-ray tube 1 further includes a cylindrical bearing housing 8 and ball bearings 7, those members serving as supporting members supporting the shaft 6. The bearing housing 8 is constructed of a portion 8*a* and a portion 8*b*. The portion 8*a* is formed of stainless steel, while the portion 8*b* is formed of an anti-corrosion metal such as Mo (molybdenum), Mo alloy, Ta (tantalum) or W (tungsten) having a corrosion resistance to Ga (gallium) or Ga alloy or of an anti-corrosion ceramic. The shaft 6 is formed of an anti-corrosion metal such as Mo, Mo alloy, Ta or W having a corrosion resistance to GA or Ga alloy or of an anti-corrosion ceramic and is provided with deep grooves 4 and 4 that serve as race surfaces in the circumferential direction. Further, an accommodating section 10 is defined by the center portion of the shaft 6 and the inner surface of the portion 8*b* of the bearing housing 8. This accommodating section 10 has taper surfaces 11 of which the diameter is maximized at the axial center portion and reduces toward the axial ends, i.e., a shape of the so-called movable counter of an abacus. A gap between the shaft 6 and the bearing housing 8 axially outside the accommodating section 10 is set to a dimension of not greater than 0.2 mm. Then, an upper portion located at the axial center of the accommodating section 10 is made to communicate with a threaded infusion hole 13, and this infusion hole 13 is in meshing engagement with a screw plug 12. This accommodating section 10 accommodates therein Ga or Ga alloy that does not substantially evaporate even in a vacuum. The shaft 6 and the portion 8*b* of the bearing housing 8, which constitute the accommodating section 10, are formed of an anti-corrosion metal such as Mo, Mo alloy, Ta or W having a corrosion resistance to Ga or Ga alloy or of ceramic. Therefore, the above members are not corroded.

On the other hand, thread-like pumping grooves 14 are provided on the shaft 6 outside both ends of the accommodating section 10. The pumping grooves 14 have a function of forcing the Ga, which is located in the gap between the shaft 6 and the bearing housing 8, back into the accommodating section 10. In regard to the pumping grooves 14, the groove angle relative to the flat plane perpendicular to the axial direction of the shaft 6 is set to 10 to 20 degrees. Further, labyrinth grooves 15 are formed on the shaft 6 outside the pumping grooves 14.

In the rotating anode X-ray tube 1 having the above construction, if a high voltage is applied across a cathode (not shown) and the target 3 that serves as an anode int he vacuum tube 2 put in a vacuum state to generate an electron beam 16 from the cathode, then the electron beam 16 collides against the target 3. In this case, X-rays 17 are generated from the target 3. Part of the heat generated int he target 3 is directly discharged out of the vacuum tube 2 from the target 3 and the rotor 5 by heat radiation. The other part of the heat generated in the target 3 is conducted to the shaft 6 and further to the bearing housing 8 via the bearings 7 and also conducted to the bearing housing 8 via the liquid metal Ga or Ga alloy located inside the accommodating section 10.

Since the area of contact between the shaft 6 and the balls of the bearings 7 is very small, therefore the quantity of heat conducted via the bearings 7 is very small. However, in regard to the heat conducted to the bearing housing 8 via the liquid metal Ga or Ga alloy located in the accommodating section 10, a good efficiency of heat conduction is achieved since the area of direct contact between the shaft 6 and the Ga or Ga alloy and the area of direct contact between the Ga or Ga alloy and the bearing housing 8 are large and the Ga or Ga alloy has great heat conductivity. The Ga or Ga alloy also operates as a coolant. Therefore, the heat can be effectively discharged to the outside from the target 3, so that the target 3 can be cooled. This prevents the target 3, the shaft 6 and the bearings 7 from having an increased temperature, so that a high output power and a long-time continuous operation of the X-ray tube can be achieved and the operating life of the bearing can be prolonged.

The shaft 6 and the portion 8*b* of the bearing housing 8 constituting the accommodating section 10 are formed of an anti-corrosion metal such as Mo, Mo alloy, Ta or W having a corrosion resistance to the Ga or Ga alloy or of an anti-corrosion ceramic, and therefore, the accommodating section 10 can be prevented from being corroded.

The threaded infusion hole 13 communicates with the upper portion in the axial center portion of the S accommodating section 10, and this facilitates easy infusion of the Ga or Ga alloy into the accommodating section 10. Particularly, if the Ga or Ga alloy is wasted during use, then it can be easily replenished. This infusion hole 13 is plugged with the screw plug 12, and this can prevent the Ga or Ga alloy from leaking out of the infusion hole 13.

Furthermore, the accommodating section 10 has the taper surfaces 11 of which the diameter is maximized at the axial center and reduces toward the axial ends like the shape of the so-called movable counter of an abacus. Therefore, by virtue of the above configuration of the accommodating section 10, no air bubble remains int he accommodating section 10, so that the gap is closely filled up by the Ga or Ga alloy.

The Ga or Ga alloy located inside the accommodating section 10 does not leak out of the accommodating section 10 for the reasons as follows.

Figure 2:
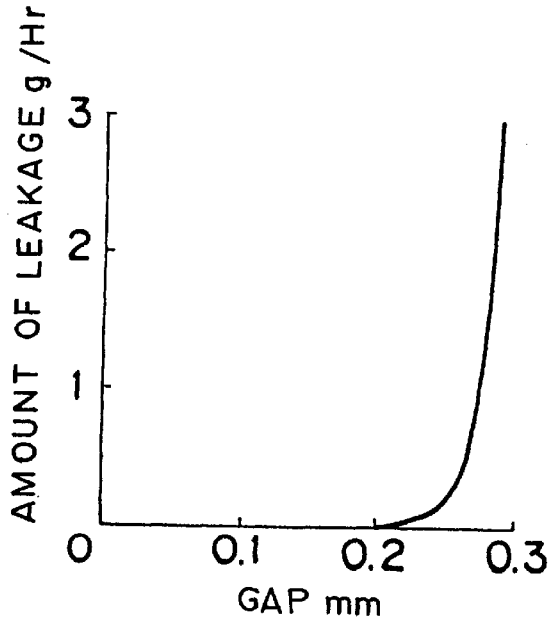
FIG. 2 is a graph showing a relation between a gap at an end portion of an accommodating section of the rotating anode X-ray tube of FIG. 1 and an amount of leakage.

FIG. 2 shows the relation of the gap (mm) between the shaft 6 and the bearing housing 8 to the quantity of leakage (g/h) of Ga. FIG. 2 shows that Ga located int he accommodating section 10 does not leak outside when the gap between shaft 6 and the bearing housing 8 is not greater than 0.2 mm. In the present embodiment, the above gap is set to 0.2 mm or smaller, and therefore, leakage of the Ga or Ga alloy is prevented.

The accommodating section 10 has the taper surfaces 11 of which the diameter is maximized at the axial center and reduces toward the axial ends like the shape of the movable counter of an abacus. By virtue of this configuration, if the Ga put in contact with the shaft 6 starts to rotate together with the rotation of the shaft 6, then a centrifugal force forces the Ga into the center portion, in which the diameter is maximized, of the accommodating section 10. Therefore, the Ga located inside the accommodating section 10 has difficulty in leaking out of both the end portions.

The pumping grooves 14 positioned on both sides of the accommodating section 10 push the Ga or Ga alloy toward the accommodating section 10 by their threads when the shaft 6 rotates even though the Ga or Ga alloy exists in the gap between the shaft 6 and the bearing housing 8. Therefore, the Ga or Ga alloy does not leak out of both the end portions.

If the pumping grooves 14 are provided on the shaft 6 as described above, then the pumping force of the pumping grooves 14 forces the leaked Ga or Ga alloy back into the accommodating section 10 when the shaft 6 rotates even though the gap between the shaft 6 and the bearing housing 8 exceeds 0.2 mm. Therefore, the Ga or Ga alloy does not leak or has difficulty in leaking out of the accommodating section 10.

Figure 5:
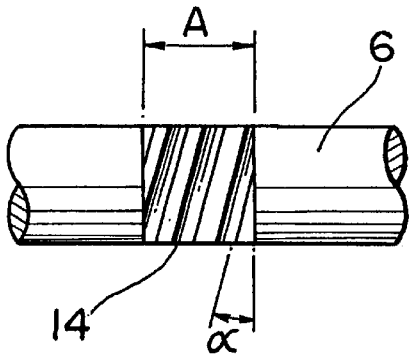
FIG. 5 is a front view of a pumping groove of the rotating anode X-ray tube of FIG. 1.
Figure 6:
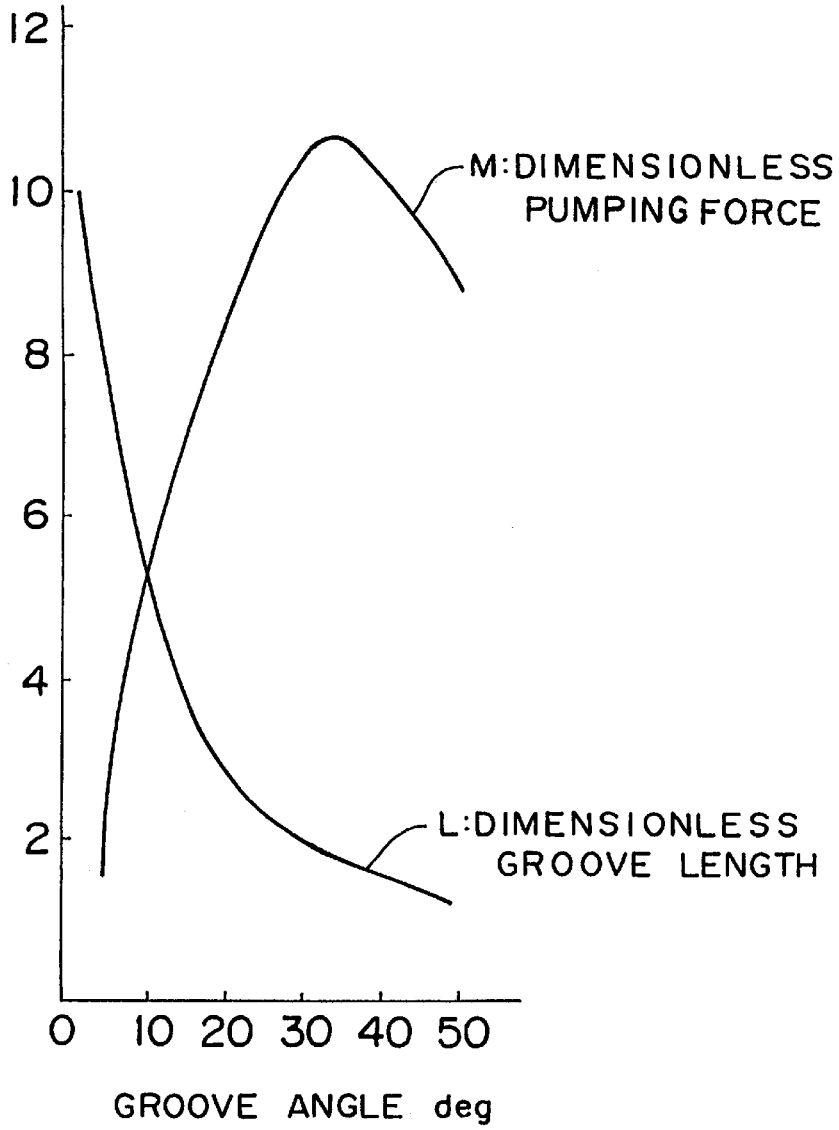
FIG. 6 is a graph showing a relation between a groove angle and a groove length as well as a relation between the groove angle and a pumping force concerning the rotating anode X-ray tube of FIG. 1.

If the rotation of the shaft 6 stops, then the Ga or Ga alloy possibly leaks to the outside through the pumping grooves 14 when the pumping grooves 14 are short. FIG. 6 shows a relation between a groove angle $\alpha$ and a dimensionless groove length L and a relation between the groove angle $\alpha$ and a dimensionless pumping force M. As shown in FIG. 5, this groove angle $\alpha$ represents the angle of the groove relative to the flat plane perpendicular to the axial direction of the shaft 6, while the dimensionless groove length L represents a value obtained by dividing the groove length within a range of an axial length A of the shaft 6 by the length A. FIG. 6 shows that the dimensionless groove length L comes to have a smaller value as the groove angle $\alpha$ increases. Therefore, in order to elongate the groove length to increase the leakage resistance, it is proper to reduce the groove angle $\alpha$. The pumping force takes its maximum value at the groove angle $\alpha$ of about 35 degrees, however, the pumping force rapidly reduces when the groove angle $\alpha$ is reduced from 35 degrees as shown in FIG. 6. As shown in FIG. 6, it was discovered that a pumping force of about fifty to eighty percent of the maximum value could be obtained and the amount of leakage of the Ga or Ga alloy is small when the groove angle $\alpha$ was 10 to 20 degrees. That is, when the groove angle $\alpha$ was set to 10 to 20 degrees, a sufficiently great pumping force could be obtained and the amount of leakage of the liquid metal Ga or Ga alloy was suppressed. This was obtained through the experimental results as follows. If the groove angle was smaller than 10 degrees, then the groove length was increased, so that the Ga or Ga alloy was hard to leak to the outside in the state of rest. However, the pumping force was reduced in operation, so that the operation for forcing the Ga or Ga alloy back into the accommodating section 10 was weakened. If the groove angle of the pumping groove 14 was not smaller than 20 degrees and not greater than about 35 degrees, then the pumping force was increased in operation to force the Ga or Ga alloy back into the accommodating section 10. However, the groove length was shortened, so that the Ga or Ga alloy leaked to the outside through the pumping groove 14 in the state of rest. If the groove angle exceeded 35 degrees, then the pumping force was weakened and the amount of leakage of the Ga or Ga alloy to the outside was concurrently increased. Thus, there were obtained the results that the sufficiently great pumping force could be obtained and the amount of leakage of the liquid metal Ga or Ga alloy could also be suppressed with the groove angle a set to 10 to 20 degrees.

On the other hand, labyrinth grooves 15 are provided outside the pumping grooves 14. Therefore, if the Ga or Ga alloy leaks out of the pumping grooves 14 while the shaft 6 is in the state of rest, then the Ga or Ga alloy can be trapped in the labyrinth grooves, so that the Ga or Ga alloy can be prevented from leaking to the outside.

According to the present embodiment, the shaft 6 that serves as the supported member is connected to the target 3 and the bearing housing 8 that serves as the supporting member is fixed to the vacuum tube 2. However, it is also acceptable to connect a sleeve (not shown) that serves as a supported member to the target and fix a shaft that serves as a supporting member to be fit into this sleeve to the vacuum tube.

Figure 3:
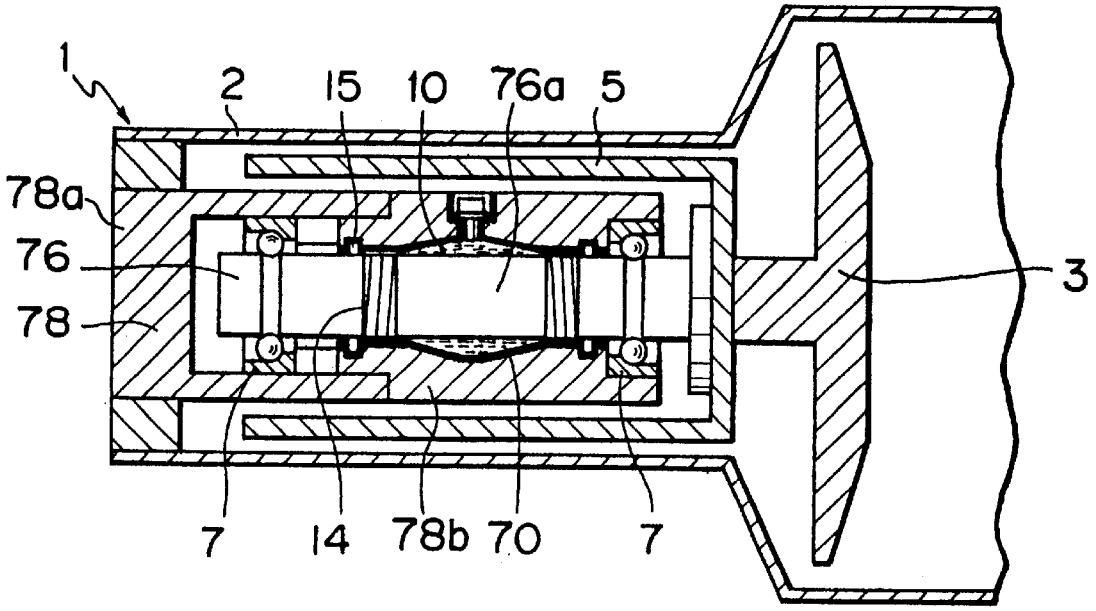
FIG. 3 is a sectional view of a rotating anode X-ray tube according to another embodiment of the present invention.
Figure 4:
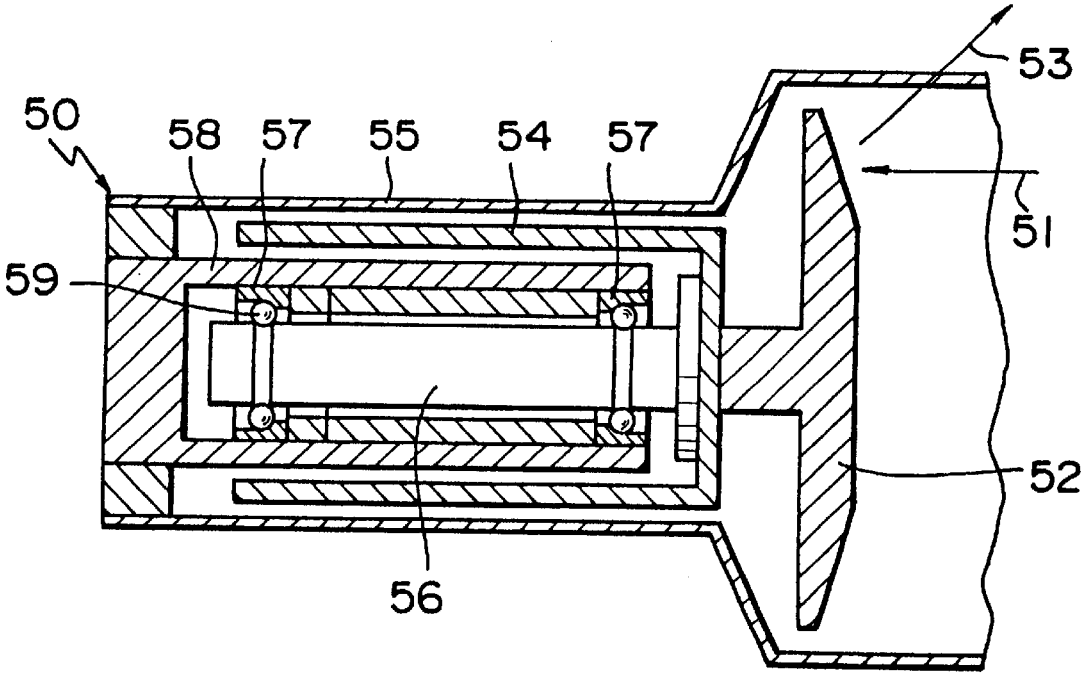
Fig.4 PRIOR ART
FIG. 4 is a sectional view of a prior art rotating anode X-ray tube.

According to the present embodiment, the shaft 6 and the portion 8*b* of the bearing housing 8, which define the accommodating section 10, are formed of an anti-corrosion metal such as Mo, Mo alloy, Ta or W having a corrosion resistance to Ga or Ga alloy or of ceramic. However, as shown in FIG. 3, it is also acceptable to form a shaft 76 and a portion 78*b* of a bearing housing 78 of stainless steel or tool steel such as SKH4 and coat the portion 78*b* of the bearing housing 78 and a portion 76*a* of the shaft 76, which define the accommodating section 10, with the film 70 of TiN. FIG. 3 is identical to FIG. 1 except for the above members, and therefore, the same components are denoted by the same reference numerals, with no description provided for them.

As described above, if the stainless steel or the tool steel such as SKH4 is coated with the film 70 of TiN, then the X-ray tube can be manufactured less expensively than when the whole bearing housing is formed of the aforementioned anti-corrosion metal or ceramic.

Although the pumping grooves 14 are provided on the shaft 6 side in the present embodiment, the grooves may be provided on the bearing housing 8 side.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotating anode X-ray tube comprising:

a supported member connected to a target;

a supporting member for supporting the supported member via rolling bearings; and a liquid metal that is accommodated in the accommodating section and does not substantially evaporate even in a vacuum;

wherein the accommodating section is provided substantially in an axial center portion between a plurality of the rolling bearings and the accommodating section has tapered surfaces of which the diameter is maximized at the axial center and reduces toward axial ends.

2. A rotating anode X-ray tube as claimed in claim 1, wherein the liquid metal is comprised of Ga or Ga alloy and the accommodating section put in contact with the Ga or Ga alloy is made of an anti-corrosion metal having a corrosion resistance to the Ga or Ga alloy or of an anti-corrosion ceramic.

3. A rotating anode X-ray tube as claimed in claim 1, wherein the liquid metal is comprised of Ga or Ga alloy and the accommodating section put in contact with the Ga or Ga alloy is formed of stainless steel or tool steel coated with TiN.

4. A rotating anode X-ray tube as claimed in claim 1, comprising an infusion hole for infusing the liquid metal into the accommodating section.

5. A rotating anode X-ray tube as claimed in claim 4, wherein the infusion hole is threaded and plugged with a screw plug.

6. A rotating anode X-ray tube as claimed in claim 1, wherein a gap between the supported member and the supporting member is not greater than 0.2 mm axially outside the accommodating section.

7. A rotating anode X-ray tube as claimed in claim 6, wherein a pumping groove for forcing the liquid metal located in the gap between the supported member and the supporting member back into the accommodating section is provided on the supported member or the supporting member.

8. A rotating anode X-ray tube as claimed in claim 7, wherein a labyrinth groove for reserving the liquid metal is formed adjacently outside the pumping groove.

9. A rotating anode X-ray tube comprising:

a supported member connected to a target;

a supporting member for supporting the supported member via rolling bearings; and a liquid metal that is accommodated in the accommodating section and does not substantially evaporate even in a vacuum;

wherein a gap between the supported member and the supporting member is mot greater than 0.2 mm axially outside the accommodating section;

wherein a labyrinth groove for reserving the liquid metal is formed adjacently outside the pumping groove; and wherein the pumping groove has a groove angle of 10 to 20 degrees with respect to a flat plane perpendicular to the axial direction of the supported member.

10. A liquid metal sealing device comprising:

a cylindrical supporting member and a columnar supported member, which rotate relative to each other;

a liquid metal interposed between the supporting member and the supported member; and a pumping groove formed on the supporting member or the supported member, wherein the pumping groove has a groove angle of 10 to 20 degrees with respect to a flat plane perpendicular to an axial direction of the supported member.

* * * * *